United States Patent [19]

Wada et al.

[11] Patent Number: 4,968,453

[45] Date of Patent: Nov. 6, 1990

[54] SYNTHETIC LUBRICATING OIL COMPOSITION

[75] Inventors: Sadao Wada, Shiki; Kenyu Akiyama, Toyota; Michihide Tokashiki, Kawagoe, all of Japan

[73] Assignees: Toyota Jidosha Kabushiki Kaisha, Toyota; TOA Nenryo Kogyo Kabushiki Kaisha, Tokyo, both of Japan

[21] Appl. No.: 234,676

[22] Filed: Aug. 22, 1988

[51] Int. Cl.[5] ..... C10M 105/12

[52] U.S. Cl. ..... 252/56 S; 252/56 R

[58] Field of Search ..... 252/56 S, 52 R, 56 R

[56] References Cited

U.S. PATENT DOCUMENTS

| | | | |
|---|---|---|---|
| 2,944,973 | 7/1960 | Langer et al. | 252/47.5 |
| 4,072,619 | 2/1978 | Williams | 252/56 S |

FOREIGN PATENT DOCUMENTS

| | | | |
|---|---|---|---|
| 52-127484 | 4/1976 | Japan . | |
| 0018860 | 1/1984 | Japan | 252/56 S |
| 0786950 | 11/1957 | United Kingdom | 252/56 S |
| 0578803 | 6/1959 | United Kingdom | 252/56 S |
| 0933721 | 8/1963 | United Kingdom | 252/56 S |

OTHER PUBLICATIONS

Elliot et al. (1961), *J. Instit. Petroleum*, vol. 47, p. 42.
Dukek (1964), J. Instit. Petroleum, vol. 50, p. 285.

*Primary Examiner*—Olik Chaudhuri
*Assistant Examiner*—James M. Hunter, Jr.
*Attorney, Agent, or Firm*—Banner, Birch, McKie & Beckett

[57] ABSTRACT

A synthetic lubricating oil composition which is suitable for lubrication of mechanical super charger, which composition comprises (A) a diester of an aliphatic dibasic acid having 4 to 14 carbon atoms and an alcohol having 4 to 14 carbon atoms, or a mixture thereof, of which viscosity at 100° C. is 2–7 $mm^2/s$; and (B) a polyoxyalkylene glycol ether or a polyoxyalkylene glycol ester having 2 to 5 carbon atoms in its alkylene group, or a mixture thereof, of which viscosity at 100° C. is not less than 30 $mm^2/s$; and which composition may further comprise (C) an α-olefin oligomer having a kinematic viscosity at 100° C. of 3–6 $mm^2/s$.

16 Claims, 3 Drawing Sheets

SYNTHETIC LUBRICATING OIL COMPOSITION

BACKGROUND OF THE INVENTION

1. FIELD OF THE INVENTION

This invention relates to a synthetic lubricating oil composition. More particularly, this invention relates to a synthetic lubricating oil composition suitable for lubrication of mechanical turbo charger, so called supercharger, for automobiles.

2. DESCRIPTION OF THE PRIOR ART

In recent years, turbo chargers, or higher performance superchargers have been developed in rapid strides for the purpose of increasing the power and reducing the fuel cost of automobiles. In particular, recently, a supercharger is being energetically developed which solves the problem of working delay of turbo chargers and is provided with preferable response characteristics, different from a turbo charger which operates by rotating the turbine with exhaust gas to drive an air compressor (a centrifugal air pump) with the turbine.

The supercharger does not utilize exhaust gas as in the case of turbo charger, but, for instance, it transfers the rotation of engine crank shaft to a belt pulley through geared belts, and transfers the rotation of the belt pulley to an air compressor (volume type air pump) through a gear train, whereby the supply air to an engine is compressed by the air compressor.

Such a supercharger has a good response to working accelerator, since the supercharger is directly connected to the engine; as a result, it has advantages in improvement of working efficiency in the range of lower speed and in reduction of its fuel cost.

The required qualities of lubricating oil used for a turbo charger and a supercharger, however, are different because of the difference in mechanism between them. That is, the former, a turbo charger, requires a lubricating oil with especially advantageous heat resistance due to the use of high temperature exhaust gas, whereas the latter, a supercharger, requires not only heat resistance but also abrasion resistance ability under the condition of high speed rotation, since the gear train driving section and the bearing are exposed to the conditions of high temperature (150° C. to 200° C.) and high speed rotation (e.g., 9000 rpm).

On the other hand, an automobile is required to be easily usable not only by a veteran but also by an ordinary driver. In addition, every part and apparatus of an automobile is required to smoothly work in its starting and running under various driving conditions, that is, in hot and cold places.

Accordingly, a lubricating oil for supercharger is needed to be provided with:

(1) high stability under the conditions of high temperature (100° C. or more) and high speed of rotation (9000 rpm);
(2) good fluidity at a low temperature (at −40° C.);
(3) good abrasion resistance;
(4) maintenance free; and
(5) the capability to reduce the fuel consumption as much as possible.

As a lubricating oil which can be used in a wide temperature range, Japanese Patent Disclosure (Kokai No. 127484/77) discloses a hydraulic oil composition comprising as the base oil a mixture of esters. However, such a base oil is solidified at a low temperature, for example, at 0° C. to −20° C., so that the base oil does not have the good fluidity at low temperature which is required for a base oil of a lubricating oil for a supercharger. On the other hand, a mineral lubricating oil with excellent low temperature fluidity has been used in practice, for example, as automobile speed change gear oil, but it cannot be qualified for the use under the condition of high speed rotation which requires further abrasion resistance, because the mineral lubricating oil has insufficient viscosity at high temperature.

In addition, synthetic lubricants of which base oil is a diester thickened by polyglycol ether, used for aviation gas turbine, are known (U.S. Pat. No. 2,944,973; Journal of the Institute of Petoleum, Vol. 47, No. 466, p42, (February 1961); and Journal of the Institute of Petroleum, Vol. 50, No. 491, p285 (November 1964) and are used in practice. However, these synthetic lubricants are not so efficiently used for a supercharger of high performance engine developed recently, because their viscosity a 100° C. is low.

At present, ATF-DII (automobile speed change gear oil Dexron II grade) and 75W-90 gear oil can be counted as a lubricating oil which may be used for automobile superchargers. The former, however, although it has a good fluidity at a low temperature, has an insufficient viscosity at a high temperature. On the other hand, the latter has a good viscosity at a high temperature, but its viscosity at a low temperature is too high and thus the fluidity at a low temperature is bad. Further, to increase the viscosity of the latter oil at a high temperature, it is required to add a viscosity index improver, which degrades the abrasion resistance.

At present, it is impossible to find a lubricant with high viscosity at a high temperature (at 100° C.) and good fluidity at a low temperature (at −40° C.) without adding any viscosity index improver.

Further, since conventional lubricants employ in general mineral oil as the base oil, their degradation severely occurs, so that it is necessary to exchange the lubricant frequently. Further, a large amount of lubricant is usually used in circulation so as to reduce its degradation.

Accordingly, the main object of the present invention is to provide an abrasion resistant synthetic lubricating oil composition which has a smaller fluctuation in viscosity in a wide temperature range than conventional lubricating oils.

Another object of the present invention is to provide an abrasion resistant synthetic lubricating oil composition which is heat resistant, which is abrasion resistant at a high speed or rotation, and which is maintenance free, that is, which can be used without exchange for a long time at a high speed of rotation (e.g., at 9000 rpm) at an oil temperature of 150° C. to 200° C., and which is especially suited for use in automobile supercharger.

SUMMARY OF THE INVENTION

The present inventors have intensively studied for attaining the above-mentioned objects to find that a lubricating oil with a small fluctuation in viscosity in a wide temperature range, that is, a lubricating oil having a high fluidity at a low temperature and a high viscosity at a high temperature, may be obtained by employing as the base oil a mixture of a prescribed diester with a good low temperature fluidity and a prescribed polyoxyalkylene glycol ether or a polyoxyalkylene glycol ester having a high viscosity at 100° C., to complete the present invention.

Thus, the present invention provides a synthetic lubricating oil composition comprising as its base oil a synthetic oil mixture composed of:

(A) a diester of a dibasic aliphatic acid having 4 to 14 carbon atoms and an alcohol having 4 to 14 carbon atoms, or a mixture thereof, of which viscosity at 100° C. is 2–7 $mm^2/s$; and (B) a polyoxyalkylene glycol ether or a polyoxyalkylene glycol ester having 2–5 carbon atoms in its alkylene group, or a mixture thereof, of which viscosity at 100° C. is not less than 30 $mm^2/s$.

Further, the present invention provides a synthetic lubricating oil composition comprising the above-mentioned (A), the above-mentioned (B) and an α-olefin oligomer (C.) having a kinematic viscosity at 100° C. of 3–6 $mm^2/s$.

The synthetic lubricating oil composition of the present invention has a small fluctuation in viscosity in a wide temperature range. That is, the composition of the present invention exhibits a good fluidity at a low temperature and good viscosity characteristics at a high temperature. The composition of the present invention also excels in heat resistance and abrasion resistance at a high speed of rotation, so that it can withstand a use at a high temperature and a high speed of rotation for a long time. Thus, the composition of the present invention is especially suited for a lubricating oil for an automobile supercharger.

DESCRIPTION OF THE PREFERRED EMBODIMENTS

Figure 1:
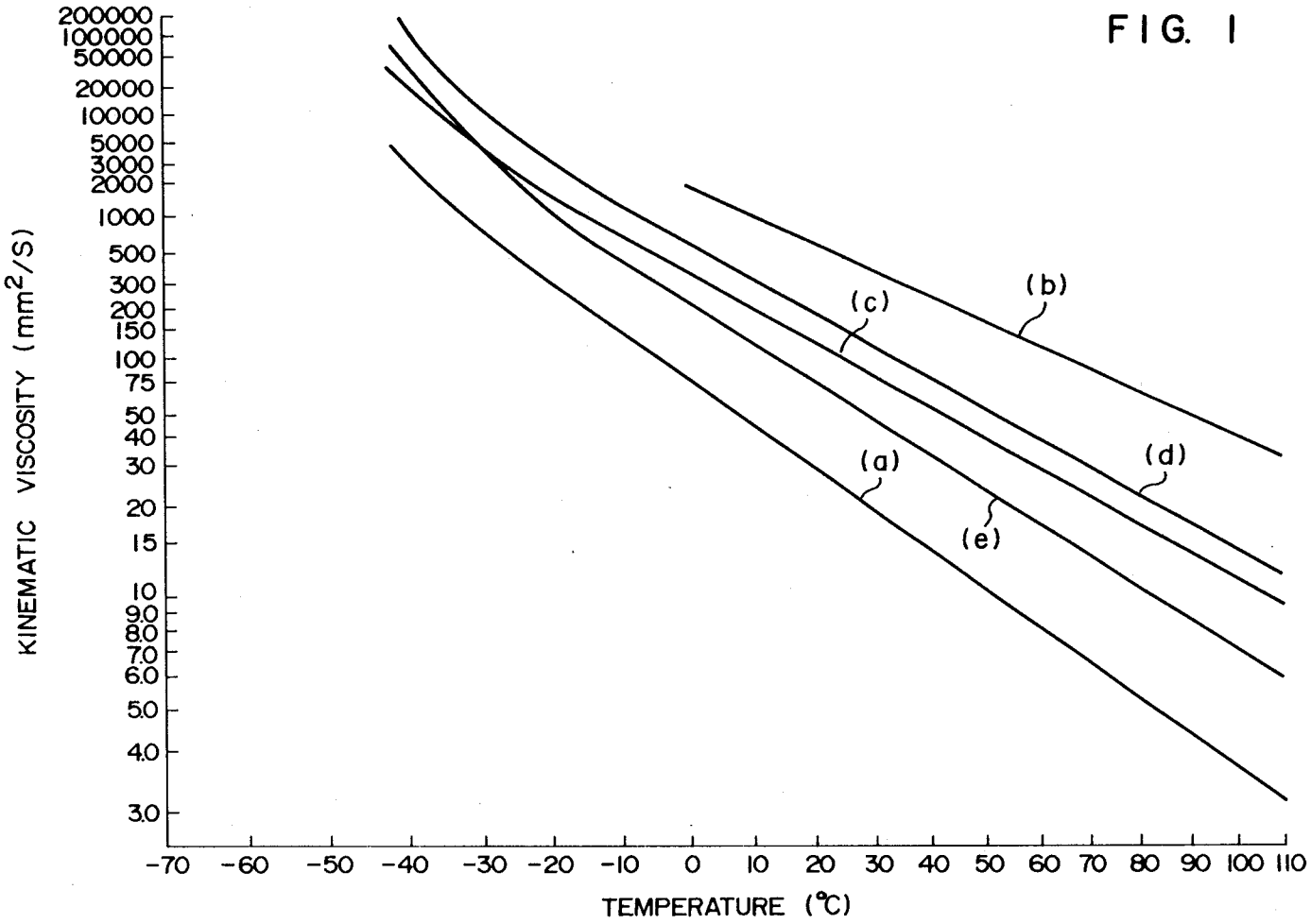
FIG. 1 is a graph showing the relationship of the temperature and the kinematic viscosity of the synthetic lubricating oil composition of the present invention, of conventional lubricating oil compositions and of each component of the base oil of the present invention.

The diester used in the present invention is obtained by condensation of an aliphatic dibasic acid with 4 to 14 carbon atoms and an alcohol with 4 to 14 carbon atoms, and the viscosity of the diester is 2 to 7 $mm^2/s$ at 100° C. Preferred examples of the aliphatic dibasic acid with 4 to 14 carbon atoms include succinic acid, glutaric acid, adipic acid, piperic acid, suberic acid, azelaic acid, sebacic acid, undecanedicarboxylic acid, dodecanedicarboxylic acid, brazilinic acid and tetradecanedicarboxylic acid. Among these, especially preferred are adipic acid, azelaic acid and sebacic acid, and the most preferred are adipic acid and sebacic acid.

Preferred examples of the alcohol with 4 t 14 carbon atoms include n-butanol, isobutanol, n-amyl alcohol, isoamyl alcohol, n-hexanol, 2-ethylbutanol, cyclohexanol, n-heptanol, isoheptanol, methylcyclohexanol, n-octanol, dimethylhexanol, 2-ethylhexanol, 2,4,4-trimethylpentanol, isooctanol, 3,5,5-trimethylhexanol, isononanol, isodecanol, isoundecanol, 2-butyloctanol tridecanol and isotetradecanol. Among these, the most preferred are 2-ethylhexanol and isodecanol. The dialcohols of these may also be favorably used.

Preferred examples of the diester used in the lubricating oil composition of the present invention include di(l-ethylpropyl) adipate, di(3-methylbutyl) adipate, di(l,3-dimethylbutyl) adipate, di(2-ethylhexyl) adipate, di(isononyl) adipate, di(undecyl) adipate, di(tridecyl) adipate, di(isotetradecyl) adipate, di(2,2,4-trimethylpentyl) adipate, di[mixed(2-ethylhexyl, isononyl)] adipate, di(l-ethylpropyl) azelate, di(3-methylbutyl) azelate, di(2-ethylbutyl) azelate, di(2-ethylhexyl) azelate, di(isooctyl) azelate, di(isononyl) azelate, di(isodecyl) azelate, di(tridecyl) azelate, di[mixed(2-ethylhexyl, isononyl)] azelate, di[mixed(2-ethylhexyl, decyl)] azelate, di[mixed(2-ethylhexyl, isodecyl)] azelate di[mixed(2-ethylhexyl, 2-propylheptyl)] azelate, di(n-butyl) sebacate, di(isobutyl) sebacate, di(l-ethylpropyl) sebacate, di(l,3-dimethylbutyl) sebacate, di(2-ethylbutyl) sebacate, di(2-ethylhexyl) sebacate di[2-(2'-ethylbutoxy)ethyl] sebacate, di(2,2,4-trimethylpentyl) sebacate, di(isononyl) sebacate, di(isodecyl) sebacate, di(isoundecyl) sebacate, di(tridecyl) sebacate, di(isotetradecyl) sebacate, di[mixed(2-ethylhexyl, isononyl)] sebacate, di(2-ethylhexyl) glutarate, di(isoundecyl) glutarate and di(isotetradecyl) glutarate.

The viscosity of the diester at 100° C. is 2 to 7 $mm^2/s$, preferably 2.2 to 7.0 $mm^2/s$. If the viscosity is lower than 2 $mm^2/s$, problems are brought about with respect to its flash point, volatility and withstand load. It the viscosity is higher than 7.0 $mm^2/s$, the effect to be brought about by mixing may not be obtained and the viscosity at low temperature becomes high.

The polyoxyalkylene glycol ether which may be used in the lubricating oil composition of the present invention may be obtained by condensation of a polyoxyalkylene glycol and an alcohol, the polyoxyalkylene glycol being a ring-opening-polymerization product or a ring-opening-copolymerization product of a straight or a branched alkylen oxide of which alkylene group has 2–5 carbon atoms, preferably 2 or 3 carbon atoms. Preferred alcohols are straight or branched aliphatic alcohols having 1–8 carbon atoms. Either monoethers or diethers may be used. Preferred examples of the ethers may include polyethylene glycol methyl ether, polyethylene glycol ethyl ether, polyethylene glycol propyl ether, polyethylene glycol butyl ether, polyethylene glycol pentyl ether, polyethylene glycol hexyl ether, methoxypolyethylene glycol methyl ether, ethoxypolyethylene glycol methyl ether, propoxypolyethylene glycol methyl ether, butoxypolyethylene glycol methyl ether, pentoxypolyethylene glycol methyl ether, hexoxypolyethylene glycol methyl ether, ethoxypolyethylene glycol ethyl ether, propoxypolyethylene glycol ethyl ether, butoxypolyethylene glycol ethyl ether, pentoxypolyethylene glycol ethyl ether, hexoxypolyethylene glycol ethyl ether, butoxypolyethylene glycol propyl ether, pentoxypolyethylene glycol propyl ether, hexoxypolyethylene glycol propyl ether, polypropylene glycol methyl ether, polypropylene glycol ethyl ether, polypropylene glycol propyl ether, polypropylene glycol butyl ether, polypropylene glycol pentyl ether, polypropylene glycol hexyl ether, methoxypolypropylene glycol methyl ether, ethoxypolypropylene glycol methyl ether, propoxypolypropylene glycol methyl ether, butoxypolypropylene glycol methyl ether, pentoxypolypropylene glycol methyl ether, hexoxypolypropylene glycol methyl ether, ethoxypolypropylene glycol ethyl ether, propoxypolypropylene glycol ethyl ether, butoxypolypropylene glycol ethyl ether, pentoxypolypropylene glycol ethyl ether and hexoxypolypropylene glycol ethyl ether.

Polyoxyalkylene glycol ethers having various viscosities may be obtained depending on the degree of dehydrating condensation and on the degree of ring-opening-polymerization. The polyoxyalkylene glycol ether used in the composition of the present invention must have a viscosity of at least 30 $mm^2/s$ at 100° C., preferably at least 50 $mm^2/s$. If the viscosity is less than 30 $mm^2/s$, the effect to be brought about by mixing may not be obtained and the viscosity characteristics at a high temperature may be degraded.

The polyoxyalkylene glycol ester used in the composition of the present invention is an ester of the above-described polyoxyalkylene glycol and an organic acid which ester has a viscosity at 100° C. of not less than 30 $mm^2/s$. Preferred organic acids are straight or branched aliphatic carboxylic acid having 1 to 10 carbon atoms, preferably 5 to 10 carbon atoms. Both monoesters and diesters may be used. Preferred examples of the esters may include polyethylene glycol pentanoic acid ester, polyethylene glycol hexanoic acid ester, polyethylene glycol heptanoic acid ester, polyethylene glycol octanoic acid ester, polyethylene glycol nonanoic acid ester, polyethylene glycol decanoic acid ester, pentanoyl-polyethylene glycol pentanoic acid ester, hexanoyl-polyethylene glycol pentanoic acid ester, heptanoyl-polyethylene glycol pentanoic acid ester, octanoyl-polyethylene glycol pentanoic acid ester, nonanoyl-polyethylene glycol pentanoic acid ester, decanoyl-polyethylene glycol pentanoic acid ester pentanoyl-polyethylene glycol hexanoic acid ester, hexanoyl-polyethylene glycol hexanoic acid ester, heptanoyl-polyethylene glycol hexanoic acid ester octanoyl-polyethylene glycol hexanoic acid ester, nonanoyl-polyethylene glycol hexanoic acid ester, decanoyl-polyethylene glycol hexanoic acid ester, octanoyl-polyethylene glycol heptanoic acid ester, nonanoyl-polyethylene glycol heptanoic acid ester, decanoyl-polyethylene glycol heptanoic acid ester, polypropylene glycol pentanoic acid ester, polypropylene glycol hexanoic acid ester, polypropylene glycol heptanoic acid ester, polypropylene glycol octanoic acid ester, polypropylene glycol nonanoic acid ester, polypropylene glycol decanoic acid ester, pentanoyl polypropylene glycol pentanoic acid ester, hexanoyl polypropylene glycol pentanoic acid ester, heptanoylpolypropylene glycol pentanoic acid ester, octanoylpolypropylene glycol pentanoic acid ester, nonanoylpolypropylene glycol pentanoic acid ester, decanoylpolypropylene glycol pentanoic acid ester, pentanoylpolypropylene glycol hexanoic acid ester, hexanoylpolypropylene glycol hexanoic acid ester, heptanoylpolypropylene glycol hexanoic acid ester, octanoylpolypropylene glycol hexanoic acid ester, nonanoylpolypropylene glycol hexanoic acid ester, decanoylpolypropylene glycol hexanoic acid ester, octanoylpolypropylene glycol heptanoic acid ester, nonanoylpolypropylene glycol heptanoic acid ester and decanoylpolypropylene glycol heptanoic acid ester.

Polyoxyalkylene glycol esters having various viscosities may be obtained depending on the degree of dehydrating condensation and o the degree of ring-opening-polymerization. The polyoxyalkylene glycol ester used in the composition of the present invention must have a viscosity of at least 30 $mm^2/s$ at 100° C., preferably at least 50 $mm^2/s$. If the viscosity is less than 30 $mm^2/s$, the effect to be brought about by mixing may not be obtained and the viscosity characteristics at a high temperature may be degraded.

Needless to say, since the base oil composed of the above-mentioned components is a base oil of a lubricating oil, it must have a lubricating viscosity at a low and high temperature. The base oil preferably has a viscosity at 100° C. of at least 9 $mm^2/s$, especially 10 to 17 $mm^2/s$, and a viscosity at −40° C. of not more than 15 $\times 10^4$ mPa.s, especially not more than $6\times 10^4$ mPa.s. The mixing ratio for obtaining a lubricating viscosity at a low and high temperature is dependent on the viscosity of the components, and the mixing ratio may easily be determined by a routine measurement of the viscosity of the mixture.

The composition of the present invention contains one of the diesters described above or a mixture of two or more thereof, and one of the polyoxyalkylene glycol ether or the polyoxyalkylene glycol ester described above or a mixture of two or more thereof. The present inventors have found that when an α-olefin oligomer which has a kinematic viscosity at 100° C. of 3–6 $mm^2/s$, preferably 4–5 $mm^2/s$, is further used as the third component, the resulting composition can be improved in abrasion resistance as compared at the same viscosity and also be improved with respect to low temperature viscosity. The monomer of the α-olefin oligomer preferably has 6–12 carbon atoms. Preferred examples of the α-olefin oligomer having 6–12 carbon atoms may include α-hexene, α-octene, α-decene, α-dodecene or a mixture thereof. Particularly preferred is α-decene having 10 carbon atoms. PAOL®, mfd. by Bray Oil Corp., can be counted as α-decene. The amount of the α-olefin oligomer to be added is preferably 5–30% by weight based on the total amount of the above-described two components, namely the diester component and the polyoxyalkylene glycol ether or polyoxyalkylene glycol ester component. If it is more than 30%, the compatibility of the α-olefin oligomer with the other two components become poor, causing the separation of the oligomer, and the mixture cannot be used as a lubricating oil. If it is less than 5%, the resulting composition is not effectively improved in its abrasion resistance and hence the addition of the oligomer is meaningless in practice.

Figure 2:
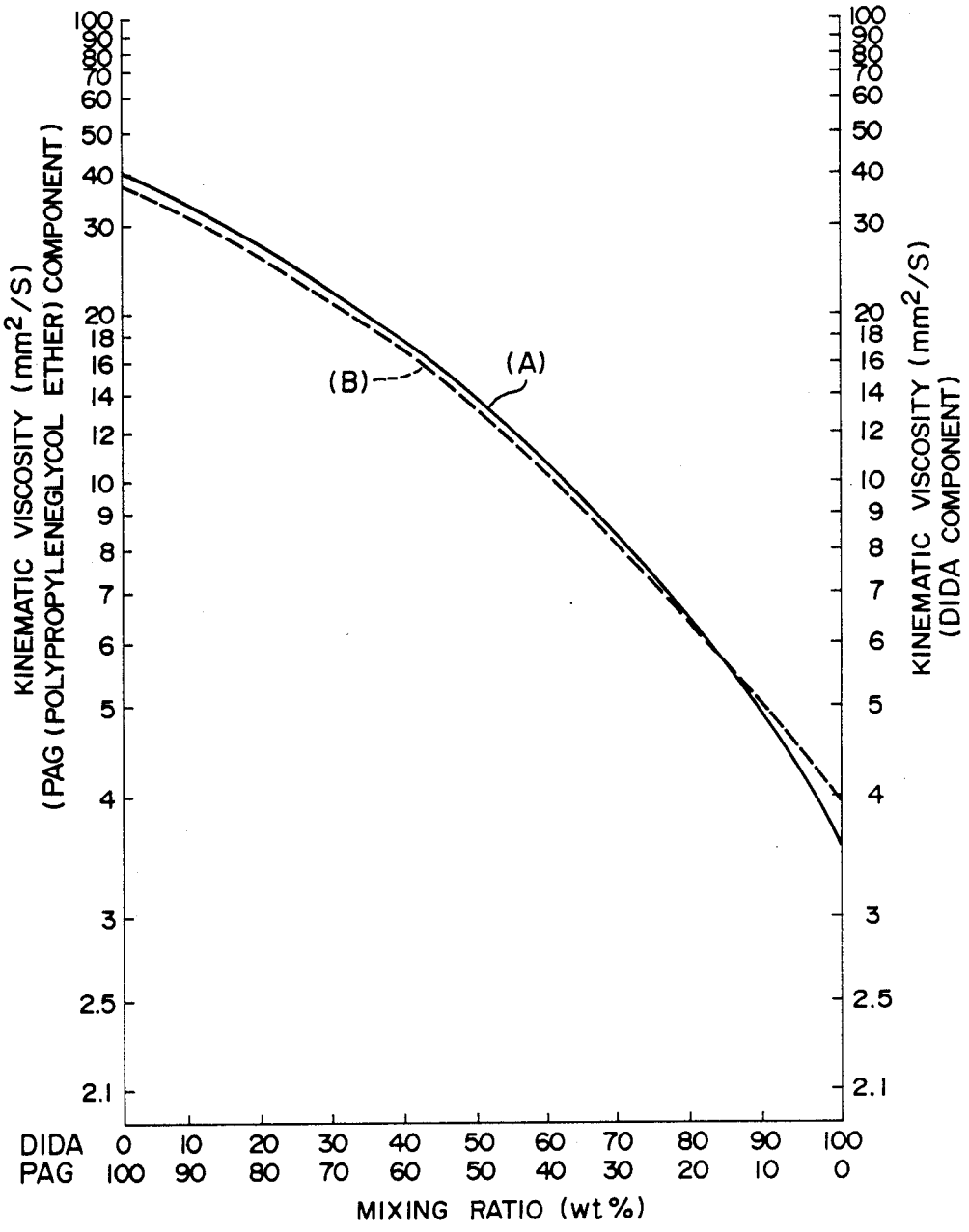
FIG. 2 is a graph showing the viscosity of the mixed base oils and of the product oils at 100° C. at various mixing ratios of diisodecyl adipate (DIDA) and butoxypolypropylene glycol butyl ether.
Figure 3:
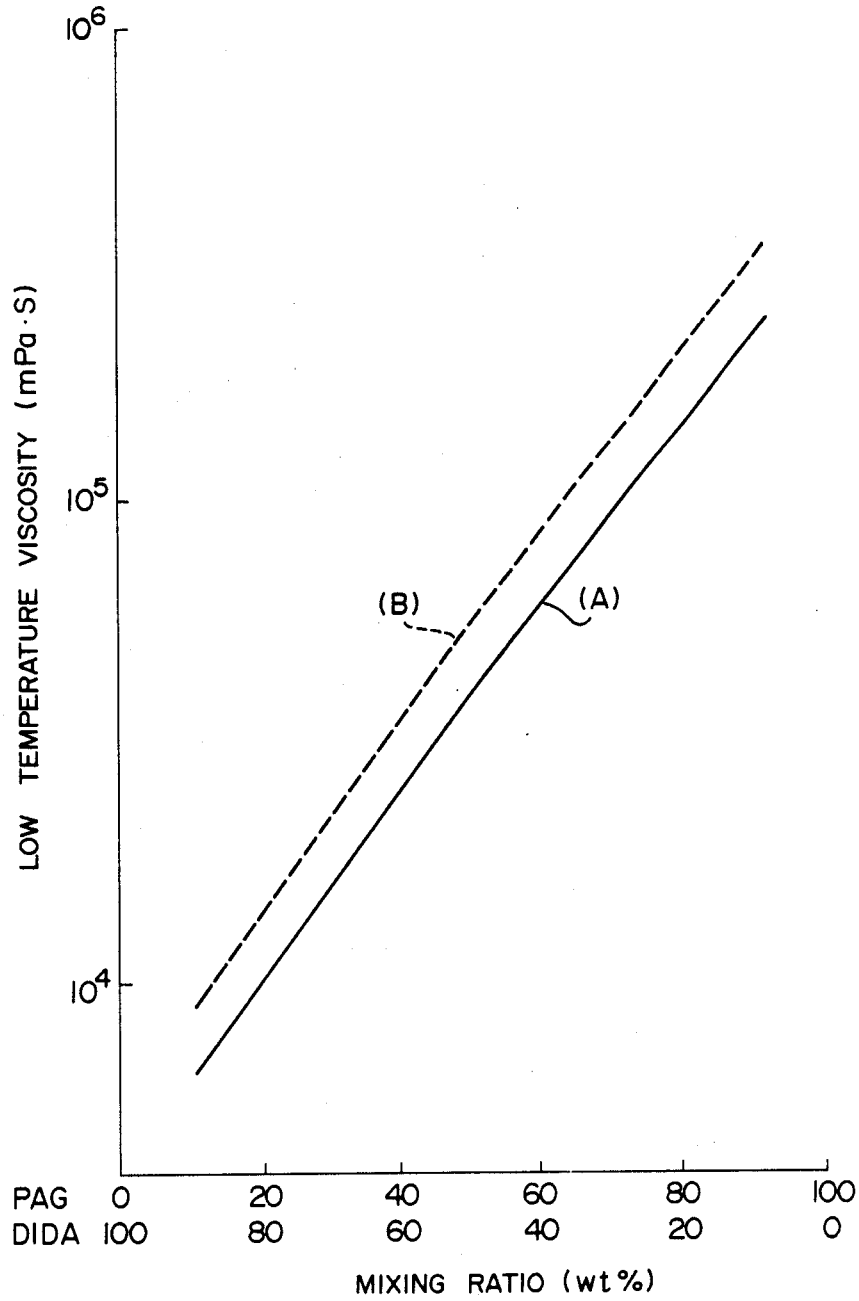
FIG. 3 shows the viscosity of the mixed base oils and of the product oils at −40° C. at various mixing ratios of diisodecyl adipate (DIDA) and buthoxypolypropylene glycol butyl ether.

The lubricating oil composition of the present invention can contain, in addition to the above-described base oil, any additive conventionally used in lubricating oils. For example, additives such as an antioxidant (0.5 to 5% by weight), an extreme pressure additive (0.5 to 10% by weight), a metal deactivator (0.01 to 2% by weight), an antirusting agent (0.05 to 1% by weight), an oiliness improver (0.01 to 1% by weight) and an antifoaming agent (0.0005 to 0.01% by weight) may be added in the amount of, for examples about 5 to 10% by weight in total. FIGS. 2 and 3 show the relationship between the viscosity characteristics of the base oil and a product oil containing the above-mentioned additives in the base oil. FIG. 2 shows the viscosity of a base oil mixture (curve A) composed of diisodecyl adipate and butoxypolypropylene glycol butyl ether, and the product oil (curve B) at 100° C. at various mixing ratios. It can be seen from FIG. 2 that although the base oil mixture has a higher viscosity at 100° C. than the product oil, the profiles of the viscosity are substantially identical. FIG. 3 shows the viscosity at −40° C. of a base oil mixture (curve A) composed of diisodecyl adipate and butoxypolypropylene glycol butyl ether, and a product oil (curve B) at various mixing ratios. It can be seen from FIG. 3 that the viscosity of the product oil is higher than that of the base oil mixture at −40° C. at any mixing ratio.

The present invention will now be described by way of examples. It should be understood that the examples are presented for the illustration purpose only and they should not be interpreted as limiting the scope of the present invention.

EXAMPLE 1

Diisodecyl adipate (DIDA) having a viscosity at 100° C. of 3.68 $mm^2/s$ and a viscosity at −40° C. of 3450 mPa.s, and butoxypolypropylene glycol butyl ether (average molecular weight of 2200) with a viscosity at 100° C. of 40.04 $mm^2/s$ which is solidified at −40° C. were mixed in the weight ratios of 8/2 (Composition A), 7/3 (Composition B), 6/4 (Composition C), 5/5 (Composition D), 4/6 (Composition E), 3/7 (Composition F) and 2/8 (Composition G), and the viscosity at 100° C. and −40° C. were determined. The results are shown in Table 1. For comparison, those of conventional lubricating oils ATF-D II and 75W-90 gear oil are also shown in Table 1. The viscosity at 100° C. was determined using Ubbelohde's viscometer (JIS K2283) and the viscosity at −40° C. was determined using Brookfield's viscometer (ASTM D-2983). In the table, the values in parentheses are the viscosity of a product oil containing 0.5–10% by weight of tricresyl phosphate (extreme pressure additive).

It is apparent from Table 1 that the base oil of the lubricating oil composition of the present invention has a higher viscosity at 100° C. than conventional base oils of lubricating oils. Further, the base oil of the lubricating oil composition of the present invention has a lubricating viscosity at −40° C., while those of the conventional lubricating oils are solidified at −40° C.

TABLE 1

| | Viscosity at 100° C. ($mm^2/S$) | Viscosity at −40° C. (mPa.S) |
|---|---|---|
| Composition A | 6.30 | 9,000 |
| | (6.26) | (12,500) |
| Composition B | 8.45 | 14,500 |
| | (8.21) | (20,000) |
| Composition C | 10.70 | 23,000 |
| | (10.20) | (33,000) |
| Composition D | 14.10 | 37,000 |
| | (13.20) | (52,000) |
| Composition E | 18.00 | 60,000 |
| | (16.50) | (84,000) |
| Composition F | 22.40 | 96,000 |
| | (20.20) | (135,000) |
| Composition G | 27.80 | 155,000 |
| | (24.60) | (220,000) |
| ATF-D II | 4.30 | Solidifies |
| | (7.21) | (42,000) |
| 75W-90 | 4.20 | Solidifies |
| Gear oil | (14.20) | (148,000) |

EXAMPLE 2

The diisodecyl adipate (DIDA) used in Example 1 and polypropylene glycol pentanoic acid ester (average molecular weight of 2900) having a viscosity at 100° C. of 93.0 $mm^2/s$ which is solidified at −40° C. were mixed in the mixing ratios by weight of 8/2 (Composition H), 3/1 (Composition I), 7/3 (Composition J), 65/35 (Composition K), 6/4 (Composition L) and 5/5 (Composition M), and the viscosity thereof at 100° C. and at −40° C. were determined as in Example 1. The results are shown in Table 2.

It is apparent from Table 2 that the base oil of the lubricating oil composition of the present invention has a higher viscosity at 100° C. than conventional base oils of lubricating oils (see Table 1). Further, the base oil of the lubricating oil of the present invention has a lubricating viscosity at −40° C., while those of the conventional lubricating oils are solidified at −40° C.

TABLE 2

| | Viscosity at 100° C. ($mm^2/S$) | Viscosity at −40° C. (mPa.S) |
|---|---|---|
| Composition H | 8.6 | 15,900 |
| Composition I | 9.7 | 22,700 |
| Composition J | 12.1 | 31,400 |
| Composition K | 14.3 | 43,600 |
| Composition L | 16.9 | 57,100 |
| Composition M | 23.5 | 109,800 |

EXAMPLE 3

The diisodecyl adipate and the butoxypolypropylene glycol butyl ether which were used in Example 1 were mixed in the ratio by weight of 65/35, and the viscosity ($mm^2/s$) at various temperature was determined. For comparison, the viscosity of these components and those of the conventional lubricating oils 75W-90 gear oil and ATF-D II were also determined. The results are shown in FIG. 1. In FIG. 1, the curves (a), (b), (c), (d) and (e) show the viscosity of diisodecyl adipate, butoxypolypropylene glycol butyl ether, mixture thereof, 75W-90 gear oil and AFT-D II, respectively.

It can be seen from FIG. 1 that the base oil of the present invention shows better high temperature viscosity characteristics than that expected from the individual viscosity of the diester and the polyoxyalkylene glycol ether, while it shows relatively lower viscosity at a low temperature. That is, the base oil of the present invention provides an unexpected effect that the viscosity change due to the temperature change is lowered by mixing each component. Further, when compared with conventional lubricating oils, the base oil of the present invention shows better viscosity characteristics over a considerably wide temperature range than the conventional lubricating oils.

EXAMPLE 4

Butoxypolypropylene glycol butyl ethers of various viscosity and the diisodecyl adipate used in Example 1 were mixed in a variety of mixing ratio by weight and the viscosity of the mixtures at 100° C. and −40° C. were determined. The results are shown in Table 3. The mixing ratio to be employed for preparing a base oil having a desired viscosity may be found from Table 3. Since such a table may easily be prepared by routine measurements, the mixing ratio for obtaining a desired viscosity may easily be determined.

TABLE 3

| | Polypropylene Glycol Ether | | 100° C. ($mm^2/S$) | | −40° C. (mPa.S) | |
|---|---|---|---|---|---|---|
| DIDA wt % | wt % | 100° C. ($mm^2/S$) | Base Oil | Product Oil | Base Oil | Product oil |
| 60 | 40 | 15.00 | 7.10 | 7.00 | 14000 | 20000 |
| 50 | 50 | " | 8.00 | 7.81 | 20000 | 28000 |
| 40 | 60 | " | 9.15 | 8.84 | 28000 | 40000 |
| 30 | 70 | " | 10.35 | 9.91 | 40000 | 56000 |
| 20 | 80 | " | 11.85 | 11.20 | 56000 | 80000 |
| 10 | 90 | " | 13.50 | 12.70 | 80000 | 110000 |
| 0 | 100 | " | 15.00 | 14.00 | 110000 | 160000 |
| 80 | 20 | 20.05 | 5.80 | 5.80 | 7500 | 10000 |
| 70 | 30 | " | 7.00 | 6.90 | 11000 | 14500 |

TABLE 3-continued

| DIDA wt % | Polypropylene Glycol Ether wt % | Polypropylene Glycol Ether 100° C. ($mm^2/S$) | 100° C. ($mm^2/S$) Base Oil | 100° C. ($mm^2/S$) Product Oil | −40° C. (mPa.S) Base Oil | −40° C. (mPa.S) Product oil |
|---|---|---|---|---|---|---|
| 60 | 40 | " | 8.10 | 7.90 | 15500 | 21000 |
| 50 | 50 | " | 9.50 | 9.15 | 22500 | 31000 |
| 40 | 60 | " | 11.10 | 10.60 | 33000 | 45000 |
| 30 | 70 | " | 13.00 | 12.20 | 48000 | 65000 |
| 20 | 80 | " | 15.10 | 10.10 | 70000 | 95000 |
| 10 | 90 | " | 17.60 | 16.20 | 96000 | 140000 |
| 0 | 100 | " | — | — | 140000 | 200000 |
| 80 | 20 | 30.00 | 6.20 | 6.17 | 8000 | 11500 |
| 70 | 30 | " | 7.65 | 7.50 | 12500 | 18000 |
| 60 | 40 | " | 9.25 | 8.93 | 19000 | 27000 |
| 50 | 50 | " | 11.30 | 10.75 | 29000 | 41000 |
| 40 | 60 | " | 14.10 | 13.10 | 45000 | 64000 |
| 30 | 70 | " | 17.30 | 15.90 | 68000 | 100000 |
| 20 | 80 | " | 21.00 | 19.10 | 105000 | 150000 |
| 10 | 90 | " | 26.50 | 23.60 | 160000 | 240000 |
| 0 | 100 | " | — | — | 250000 | 360000 |
| 80 | 20 | 40.04 | 6.30 | 6.26 | 9000 | 12500 |
| 70 | 30 | " | 8.45 | 8.21 | 14500 | 20000 |
| 60 | 40 | " | 10.70 | 10.20 | 23000 | 33000 |
| 50 | 50 | " | 14.10 | 13.20 | 37000 | 52000 |
| 40 | 60 | " | 18.00 | 16.50 | 60000 | 84000 |
| 30 | 70 | " | 22.40 | 20.20 | 96000 | 135000 |
| 20 | 80 | " | 27.60 | 24.60 | 155000 | 220000 |
| 10 | 90 | " | — | — | 250000 | 350000 |
| 0 | 100 | " | — | — | 400000 | 580000 |
| 80 | 20 | 50.00 | 7.00 | 6.91 | 10500 | 14500 |
| 70 | 30 | " | 9.00 | 8.70 | 18000 | 25000 |
| 60 | 40 | " | 11.70 | 11.10 | 31000 | 44000 |
| 50 | 50 | " | 15.50 | 14.40 | 53000 | 75000 |
| 40 | 60 | " | 20.40 | 18.60 | 90000 | 130000 |
| 30 | 70 | " | 25.90 | 23.20 | 160000 | 230000 |
| 20 | 80 | " | — | — | 270000 | 400000 |
| 10 | 90 | " | — | — | 480000 | 690000 |
| 90 | 10 | 90.00 | 5.85 | 5.85 | 7600 | 11000 |
| 80 | 20 | " | 8.50 | 8.25 | 17000 | 23000 |
| 70 | 30 | " | 11.00 | 10.50 | 36000 | 50000 |
| 60 | 40 | " | 16.15 | 15.00 | 77000 | 110000 |
| 50 | 50 | " | 23.50 | 21.60 | 170000 | 240000 |
| 40 | 60 | " | — | — | 380000 | 530000 |
| 30 | 70 | " | — | — | 800000 | 1200000 |
| 90 | 10 | 160.0 | 6.10 | 6.08 | 10500 | 15000 |
| 80 | 20 | " | 9.80 | 7.42 | 33000 | 46000 |
| 70 | 30 | " | 15.00 | 14.00 | 100000 | 150000 |
| 60 | 40 | " | 23.00 | 20.70 | 330000 | 450000 |
| 50 | 50 | " | 32.10 | 28.20 | 1000000 | 1450000 |

EXAMPLE 5

The synthetic lubricating oil compositions A to G prepared in Example 1 were each incorporated with the same amount of the same additive to give product oils having the viscosity characteristics shown in Table 1. The product oils thus obtained were subjected to an actual machine test using a supercharger. The operating conditions for the supercharger were as follows: oil temperature: 150° C., number of rotation of the rotor of air compressor: 8,250 r.p.m, operating time: 200 hours. The results of the test are shown in Table 4. It can be recognized from Table 4 that, since contamination by Fe is as severe as 240 ppm in Composition B while it is greatly decreased in Compositions C to G, the viscosity at 100° C. is required to be at least 9 $mm^2/s$

TABLE 4

| Test oil | 75W-90 Gear oil | ATF-D II | Synthetic lubricating oil composition A | B | C | D | E | F | G |
|---|---|---|---|---|---|---|---|---|---|
| Elemental analysis of oil (Fe, ppm) | 680 | 341 | 253 | 240 | 72 | 41 | 30 | 28 | 26 |

TABLE 4-continued

| Test oil | 75W-90 Gear oil | ATF-D II | Synthetic lubricating oil composition A | B | C | D | E | F | G |
|---|---|---|---|---|---|---|---|---|---|
| (Fe, ppm) | | | | | | | | | |

EXAMPLE 6

The synthetic lubricating oil compositions H to M prepared in Example 2 were each incorporated with the same amount of the same additive to give product oils having the viscosity characteristics shown in Table 2. The product oils thus obtained were subjected to an actual machine test using a supercharger. The operating conditions for the supercharger were the same as in Example 5. The results of the test are shown in Table 5. It can be recognized from Table 5 that, since contamination by Fe is as severe as 248 ppm in Composition H while it is greatly decreased in Compositions I to M, the viscosity at 100° C. is required to be at least 9 $mm^2/s$.

TABLE 5

| Test oil | 75W-90 Gear oil | ATF-D II | Synthetic lubricating oil composition H | I | J | K | L | M |
|---|---|---|---|---|---|---|---|---|
| Elemental analysis of oil (Fe, ppm) | 680 | 341 | 248 | 88 | 59 | 44 | 32 | 26 |

EXAMPLE 7

The diisodecyl adipate and the butoxypolypropylene glycol butyl ether which were used in Example 1 were mixed in various proportions and the resulting mixtures were each incorporated with a decene oligomer (Paol ®−40, mfd. by Bray Oil Corp., viscosity at 100° C.: 3.86 $mm^2/s$, viscosity at −40° C.: 2,080 mPa.s) used as an α-olefin oligomer of the third component, to give synthetic lubricating oil compositions A' to G'. The synthetic lubricating oil compositions A' to G' were so prepared as to have approximately the same viscosity (see Table 6) as those of the synthetic lubricating oil compositions A to G prepared in Example 1, respectively, by slightly modifying the mixing ratios of diisodecyl adipate and butoxypolypropylene glycol butyl ether used in preparing the lubricating oil compositions A to G in Example 1, more particularly by increasing the proportion of butoxypolypropylene glycol butyl ether. The decene oligomer was added in a proportion of 20% by weight relative to the mixture of diisodecyl adipate and butoxypolypropylene glycol butyl ether.

The synthetic lubricating oil compositions A' to G' were each incorporated with the same amount of the same additive and then subjected to an actual machine test using a supercharger. The operating conditions for the supercharger were as follows: oil temperature: 150° C., number of rotation of the rotor of air compressor: 8,250 r.p.m, operating time: 200 hours. The results of the test ar shown in Table 7.

It can be seen from Tables 4 and 7 that the synthetic lubricating oil compositions A' to G' have more improved abrasion resistance than the synthetic lubricating oil compositions A to G of Example 1.

TABLE 6

| | Viscosity at 100° C. ($mm^2/s$) | | Viscosity at −40° C. (mPa.s) | |
|---|---|---|---|---|
| Composition A' | 6.30 | (6.26) | 7200 | (10200) |
| Composition B' | 8.50 | (8.26) | 14800 | (20500) |
| Composition C' | 10.70 | (10.20) | 22400 | (32000) |
| Composition D' | 14.00 | (13.10) | 36700 | (51000) |
| Composition E' | 18.10 | (16.50) | 60000 | (84000) |
| Composition F' | 22.50 | (20.00) | 95000 | (134000) |
| Composition G' | 28.00 | (24.40) | 146000 | (210000) |

Note:

The values in parentheses are the viscosities of product oils containing 0.5–10% by weight of tricresyl phosphate (extreme pressure additive) and other additives.

TABLE 7

| Test oil | 75W-90 Gear oil | ATF-D II | Synthetic lubricating oil composition A' | B' | C' | D' | E' | F' | G' |
|---|---|---|---|---|---|---|---|---|---|
| Elemental analysis of oil (Fe, ppm) | 680 | 341 | 211 | 202 | 58 | 35 | 25 | 22 | 20 |

EXAMPLE 8

The diisodecyl adipate and the polypropylene glycol pentanoic acid ester which were used in Example 2 were mixed in various proportions and the resulting mixtures were each incorporated with a decene oligomer (Paol®−40, mfd. by Bray Oil Corp., viscosity at 100° C.: 3.86 $mm^2/s$, viscosity at −40° C.: 2,080 mPa.s) used as an α-olefin oligomer of the third component, to give synthetic lubricating oil compositions H' to M'. The synthetic lubricating oil compositions H' to M' were so prepared as to have approximately the same viscosity (see Table 8) as those of the synthetic lubricating oil compositions H to M prepared in Example 2, respectively, by slightly modifying the mixing ratios of diisodecyl adipate and polypropylene glycol pentanoic acid ester used in preparing the lubricating oil compositions H to M in Example 2 more particularly by increasing the proportion of polypropylene glycol pentanoic acid ester. The decene oligomer was added in a proportion of 20% by weight relative to the mixture of diisodecyl adipate and polypropylene glycol pentanoic acid ester.

The synthetic lubricating oil compositions H' to M' prepared above were each incorporated with the same amount of the same additive and then subjected to an actual machine test using a supercharger. The operating conditions for the supercharger were the same as in Example 7. The results of the test are shown in Table 9.

It can be seen from Tables 5 and 9 that the synthetic lubricating oil compositions H' to M' have more improved abrasion resistance than the synthetic lubricating oil compositions H to M of Example 6.

TABLE 8

| | Viscosity at 100° C. ($mm^2/s$) | Viscosity at −40° C. (mPa.s) |
|---|---|---|
| Composition H' | 8.60 | 15,700 |
| Composition I' | 9.80 | 19,700 |
| Composition J' | 12.0 | 28,200 |
| Composition K' | 14.3 | 39,500 |
| Composition L' | 17.0 | 51,800 |

TABLE 8-continued

| | Viscosity at 100° C. ($mm^2/s$) | Viscosity at −40° C. (mPa.s) |
|---|---|---|
| Composition M' | 23.4 | 107,700 |

TABLE 9

| Test oil | 75W-90 Gear oil | ATF-D II | Synthetic lubricating oil composition H' | I' | J' | K' | L' | M' |
|---|---|---|---|---|---|---|---|---|
| Elemental analysis of oil (Fe, ppm) | 680 | 341 | 200 | 68 | 48 | 37 | 26 | 21 |

What is claimed is:

1. A synthetic lubricating oil composition comprising as its base oil a synthetic oil mixture comprising:

(A) a diester of (i) an aliphatic dibasic acid having 4 to 14 carbon atoms and (ii) an aliphatic monoalcohol having 4 to 14 carbon atoms, or a mixture of said diesters, or which viscosity at 100° C. is 2–7 $mm^2/s$; and (B) a polyoxyalkylene glycol ether or a polyoxyalkylene glycol ester having 2 to 5 carbon atoms in its alkylene group, or a mixture thereof, of which viscosity at 100° C. is not less than 30 $mm^2/s$;

wherein the base oil has a viscosity at 100° C. of not less than 9 $mm^2/s$ and a viscosity at −40° C. of not more than $15\times10^4$ mPa.s.

2. The composition according to claim 1 wherein the viscosity of the base oil at 100° C. is 10–17 $mm^2/s$.

3. The composition according to claim 1 wherein the aliphatic dibasic acid has 6 to 12 carbon atoms and the aliphatic monoalcohol has 6 to 10 carbon atoms.

4. The composition according to claim 1 wherein the alcohol is an alicyclic monoalcohol.

5. The composition according to claim 4 wherein

6. The composition according to claim 1 wherein the polyoxyalkylene glycol ether is an ether of a polyoxyalkylene glycol having 2 to 5 carbon atoms in its alkylene group, and a straight or branched aliphatic alcohol having 1 to 8 carbon atoms.

7. The composition according to claim 1 wherein the polyoxyalkylene glycol ester is an ester of a polyoxyalkylene glycol having 2 to 5 carbon atoms in its alkylene group and a straight or branched aliphatic carboxylic acid having 1 to 10 carbon atoms.

8. The composition according to claim 1 wherein the aliphatic carboxylic acid has 5 to 10 carbon atoms.

9. The composition according to claim 1 wherein the diester is diisodecyl adipate and the polyoxyalkylene glycol ether or the polyoxyalkylene glycol ester is polypropylene glycol ether o polypropylene glycol ester.

10. The composition according to claim 1 wherein the viscosity of the diester is 2.2–7.0 $mm^2/s$ at 100° C. and the viscosity of the polyoxyalkylene glycol ether or the polyoxyalkylene glycol ester is not less than 50 $mm^2/s$ at 100° C.

11. The composition according to claim 1 which further comprises an effective amount of at least an extreme pressure additive, an antioxidant and a metal deactivator.

12. The composition according to claim 1 wherein the synthetic lubricating oil composition is a lubricating oil composition for a supercharger for automobiles.

13. A synthetic lubricating oil composition comprising (A) a diester of an aliphatic dibasic acid having 4 to 14 carbon atoms and an alcohol having 4 to 14 carbon atoms, or a mixture thereof, of which viscosity at 100° C. is 2–7 $mm^2/s$;

(B) a polyoxyalkylene glycol ether or a polyoxyalkylene glycol ester having 2 to 5 carbon atoms in its alkylene group, or a mixture thereof, of which viscosity at 100° C. is not less than 30 $mm^2/s$; and (C) an $\alpha$-olefin oligomer having a kinematic viscosity at 100° C. of 3–6 $mm^2/s$.

14. The composition according to claim 13 which further comprises an effective amount of at least an extreme pressure additive, an antioxidant and a metal deactivator and which composition has a viscosity at −40° C. of not more than $15\times10^4$ mPa.s.

15. The composition according to claim 13 wherein the synthetic lubricating oil composition is a lubricating oil composition for a supercharger for automobiles.

16. A synthetic lubricating oil composition for use in automobile superchargers comprising as its base oil a synthetic oil mixture consisting essentially of:

(A) a diester of (i) an aliphatic dibasic acid having 4 to 14 carbon atoms and (ii) an aliphatic monoalcohol having 4 to 14 carbon atoms, or a mixture of said diesters, or which viscosity at 100° C. is 2–7 $mm^2s$; and (B) a polyoxyalkylene glycol ether or a polyoxyalkylene glycol ester having 2 to 5 carbon atoms in its alkylene group, or a mixture thereof, of which viscosity at 100° C. is not less than 30 $mm^2/s$, wherein the base oil has a viscosity at 100° C. of not less than 9 $mm^2/s$ and a viscosity at −40° C. of not more than $15\times10^4$ mPa.s.

* * * * *

UNITED STATES PATENT AND TRADEMARK OFFICE

CERTIFICATE OF CORRECTION

PATENT NO. : 4,968,453
DATED : November 6, 1990
INVENTOR(S) : Sadao Wada, et. al.

It is certified that error appears in the above-indentified patent and that said Letters Patent is hereby corrected as shown below:

Column 12, Claim 5, line, after "wherein" insert -- the alicyclic monoalcohol is cyclohexanol or methylcyclohexanol.--

Signed and Sealed this

Ninth Day of November, 1993

Bruce Lehman

*Attest:*

BRUCE LEHMAN

*Attesting Officer*

*Commissioner of Patents and Trademarks*

US004968453B1

REEXAMINATION CERTIFICATE (1996th)

United States Patent [19]

[11] B1 4,968,453

Wada et al.

[45] Certificate Issued May 4, 1993

[54] SYNTHETIC LUBRICATING OIL COMPOSITION

[75] Inventors: Sadao Wada, Shiki; Kenyu Akiyama, Toyota; Michihide Tokashiki, Kawagoe, all of Japan

[73] Assignees: Toyota Jidosha Kabushiki Kaisha, Toyota; TOA Nenryo Kogyo Kabushiki Kaisha, Tokyo, both of Japan

Reexamination Request:
No. 90/002,511, Nov. 18, 1991

Reexamination Certificate for:

| | |
|---|---|
| Patent No.: | **4,968,453** |
| Issued: | **Nov. 6, 1990** |
| Appl. No.: | **234,676** |
| Filed: | **Aug. 22, 1988** |

[51] Int. Cl.[5] ..... C10M 105/12; C10M 105/18

[52] U.S. Cl. ..... 252/56 S; 252/56 R; 252/57; 252/43

[58] Field of Search ..... 252/56 S, 57, 56 R, 252/43

[56] References Cited

U.S. PATENT DOCUMENTS

| | | | |
|---|---|---|---|
| 2,944,973 | 7/1960 | Langer et al. | 252/56 S |
| 3,049,493 | 8/1962 | Young et al. | 252/56 S |
| 4,519,932 | 5/1985 | Schnur et al. | 252/56 S |
| 4,719,025 | 1/1988 | Akiyama et al. . | |
| 4,751,012 | 6/1988 | Ward et al. | 252/56 S |
| 4,912,272 | 3/1990 | Wu | 252/56 S |

FOREIGN PATENT DOCUMENTS 933721 8/1963 United Kingdom .

OTHER PUBLICATIONS

Polymeric Additives for Synthetic Ester Lubricants, F. J. Glavis, Industrial and Engineering Chemistry, Dec. 1950, vol. 42, No. 12, pp. 2441–2446.

*Primary Examiner*—Jerry D. Johnson

[57] ABSTRACT

A synthetic lubricating oil composition which is suitable for lubrication of mechanical super charger, which composition comprises (A) a diester of an aliphatic dibasic acid having 4 to 14 carbon atoms and an alcohol having 4 to 14 carbon atoms, or a mixture thereof, of which viscosity at 100° C. is 2–7 $mm^2/s$; and (B) a polyoxyalkylene glycol ether or a polyoxyalkylene glycol ester having 2 to 5 carbon atoms in its alkylene group, or a mixture thereof, of which viscosity at 100° C. is not less than 30 $mm^2/s$; and which composition may further comprise (C) an α-olefin oligomer having a kinematic viscosity at 100° C. of 3–6 $mm^2/s$.

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 13–15 is confirmed.

Claims 1–12 and 16 are cancelled.

* * * * *